US006819240B2

(12) United States Patent
Iwasawa et al.

(10) Patent No.: US 6,819,240 B2
(45) Date of Patent: Nov. 16, 2004

(54) ANTI-THEFT SECURITY SENSOR ASSEMBLY

(75) Inventors: Masashi Iwasawa, Otsu (JP); Tsuyoshi Hatano, Otsu (JP); Hiroyuki Ikeda, Otsu (JP)

(73) Assignee: Optex Co., Ltd., Shiga (JP)

( * ) Notice: Subject to any disclaimer, the term of this patent is extended or adjusted under 35 U.S.C. 154(b) by 0 days.

(21) Appl. No.: 10/247,956

(22) Filed: Sep. 20, 2002

(65) Prior Publication Data

US 2003/0058104 A1 Mar. 27, 2003

(30) Foreign Application Priority Data

Sep. 26, 2001 (JP) ..... 2001-293567

(51) Int. Cl.[7] ..... G08B 13/00

(52) U.S. Cl. ..... 340/541; 340/556; 340/693.6; 340/545.3

(58) Field of Search ..... 340/541, 545.3, 340/542, 567, 506, 565, 556, 693.6, 557, 555, 686.1, 687; 250/221, 222.1

(56) References Cited

U.S. PATENT DOCUMENTS

| | | | | |
|---|---|---|---|---|
| 4,451,733 A | | 5/1984 | Avery et al. | |
| 4,650,989 A | | 3/1987 | Frigon | |
| 5,128,548 A | | 7/1992 | Goodson et al. | |
| 5,334,972 A | | 8/1994 | Sugimoto et al. | |
| 5,596,310 A | | 1/1997 | Itoh | |
| 5,790,040 A | * | 8/1998 | Kreier et al. | 340/693.1 |
| 6,040,771 A | * | 3/2000 | Kim | 340/5.31 |
| 6,097,300 A | * | 8/2000 | Wei | 340/693.5 |
| 6,377,174 B1 | * | 4/2002 | Siegwart et al. | 340/541 |
| 6,472,997 B2 | * | 10/2002 | Leen | 340/815.45 |
| 6,597,287 B1 | * | 7/2003 | Steinel | 340/541 |

FOREIGN PATENT DOCUMENTS

| | | |
|---|---|---|
| EP | 0 466 522 | 7/1991 |
| EP | 0 821 329 | 1/1998 |
| EP | 1 233 283 | 8/2002 |

* cited by examiner

*Primary Examiner*—Anh V. La

(57) ABSTRACT

To provide an anti-thief security sensor assembly wherein an optical axis of a beam projecting unit can be accurately aligned with that of a beam receiving unit, the anti-thief security sensor assembly includes a beam projecting unit 1 for projecting an infrared beam IR and a beam receiving unit 8 for receiving the infrared beam IR. The beam projecting unit 1 includes a projector cover 21A detachably mounted on a mounting base 20A for enclosing and protecting a sensor circuit on the mounting base 20A, an opening detecting switch 7 for detecting a physical opening of the projector cover 21A, and a projected beam suppressing circuit 4 operable in response to detection by the opening detecting switch 7 to reduce a quantity of the infrared beam emitted from the beam projecting unit 1 to thereby reproduce the infrared beam of a quantity substantially equal to that having passed through the projector cover 21A. The beam receiving unit 8 includes a receiver cover 21 detachably mounted on a mounting base 20 for enclosing and protecting a sensor circuit on the mounting base 20, an opening detecting switch 18 for detecting a physical opening of the receiver cover 21 and a received beam level suppressing circuit 19 operable in response to detection by the opening detecting switch 18 to lower the level of the beam signal received by the beam receiving unit 8 to thereby reproduce reduction of the amount of the received infrared beam caused by the receiver cover 21.

15 Claims, 3 Drawing Sheets

ANTI-THEFT SECURITY SENSOR ASSEMBLY

BACKGROUND OF THE INVENTION

1. Field of the Invention

The present invention relates to an anti-thief security sensor assembly of a type wherein while an infrared beam emitted from an infrared beam projecting unit is constantly received by an infrared beam receiving unit, an alarm is generated when an intruder traverses across the path of travel of the infrared beam from the infrared beam projecting unit towards the infrared beam receiving unit.

2. Description of the Prior Art

The anti-thief security sensor assembly is known in which a beam projector of an infrared beam projecting unit and a beam receiver of an infrared beam receiving unit are installed at opposite ends of a rectilinear guard area spaced an appropriate distance from each other with their optical axes aligned with each other. The infrared beam receiving unit is so operated that when the receiver senses the infrared beam the receiver can output an electric signal of a signal level proportional to the amount of the infrared beam received. The electric signal so outputted is, after having been amplified by an amplifier circuit, processed by a detecting circuit to remove a disturbance light component therefrom and then to convert it into a signal of a level proportional to the received beam signal, and the converted signal level from the detecting circuit is subsequently determined by a signal discriminating circuit as to whether or not the level of the converted signal is lower than a predetermined detection level. In the event that the level of the received beam signal attains a value lower than the predetermined detection level as a result of the infrared beam from the beam projecting unit towards the beam receiving unit having been intercepted by traverse of an intruder, the signal discriminating circuit outputs a detection signal with which an alarm generator is driven to output an alarm signal that may be utilized to warn that the intruder has entered the guard area.

The anti-thief security sensor assembly is generally capable of monitoring the guard area ranging from a rectilinearly close distance to a rectilinearly long distance of a few hundred meters, and the longer the rectilinear distance, the more difficult it is to install the beam projector and the beam receiver with their optical axes aligned with each other as accurately as possible at respective locations that are spaced a distance from each other. Accordingly, the conventional anti-thief security sensor assembly includes a sighting instrument so as to facilitate the alignment of the respective optical axes of the beam projecting and receiving units with each other. To align the respective optical axes of the beam projecting and receiving units with each other at the time of installation or servicing of the anti-thief security sensor assembly, a servicing worker has to look through a viewing hole of the sighting instrument mounted on the beam projecting and receiving units respectively to adjust the angle of orientation of the beam receiving unit in both vertical and horizontal directions to coarsely align the respective optical axes of the beam projecting and receiving units with each other. Once this has been done, while the signal level proportional to the amount of the infrared beam received by the beam receiver is read out with the use of a level meter such as, for example, a voltmeter electrically connected with and built in the detecting circuit of the beam receiving unit, the angle of orientation of the beam receiver in the vertical and horizontal directions are finely adjusted to render the reading of the signal level to attain more than a predetermined level of the infrared that ought to be received, thereby completing the job of aligning the respective optical axes of the beam projecting and receiving units.

Considering that electro-optical component parts of each of the beam projecting and receiving units including the sighting instrument are generally covered and protected by a cover for each of the beam projecting and receiving units to avoid an unauthorized access thereto, the projector and receiver covers have to be removed in order for a servicing worker to perform adjustment of the sighting instrument and reading of a display on the level meter in each of the beam projecting and receiving units when the optical axis adjustment, i.e., alignment of the respective optical axes of the beam projector and the beam receiver with each other is desired to be carried out.

However, each of the projector and receiver covers is made of a colored material capable of absorbing a certain quantity of the infrared beam passing through the respective cover and, therefore, the infrared beam projected from the beam projector and received by the beam receiver is correspondingly attenuated to a certain extent. For example, in the case of the black-colored cover used for each of the beam projecting and receiving units, about 30% of the infrared beam would be absorbed and attenuated by the respective cover as compared with that before it passes through the respective cover. Accordingly, removal of the projector and receiver covers consequently results in that the amount of the infrared beam received by the beam receiver which has been absorbed and attenuated by the projector and receiver covers increases a quantity substantially equal to the amount of the infrared beam absorbed and attenuated by the projector and receiver covers. In other words, each of the projector and receiver covers is capable of absorbing and attenuating the infrared beam in a quantity corresponding to about 30% thereof and, hence, removal of the projector and receiver covers results substantially in increasing the total infrared beam output of the beam projector being received by the beam receiver.

If the signal level of the infrared beam received by the beam receiver becomes too high as a result of the removal of the projector and receiver covers, not only would an output from an automatic gain control (AGC) circuit employed in the beam receiving unit be saturated, but also the level of the received beam signal, i.e., the level of an output from the beam receiver would attain a value higher than a predetermined level even in the case of misalignment of the respective optical axes of the beam projecting and receiving units with each other because of reflection of the infrared beam from, for example, a wall surface adjacent the site of installation of the anti-thief security sensor assembly. Once this occurs, an accurate optical axis adjustment is indeed difficult to achieve.

SUMMARY OF THE INVENTION

In view of the foregoing, the present invention is intended to provide an anti-thief security sensor assembly wherein the optical axis adjustment can be accurately performed even when only one of the projector and receiver covers is physically opened.

In order to accomplish the foregoing object of the present invention, there is provided, in accordance with one aspect of the present invention, an anti-thief security sensor assembly including a beam projecting unit for projecting an infrared beam and a beam receiving unit for receiving the infrared beam projected by the beam projecting unit and operable to detect a human body or the like in the event that the human body or the like traverses the optical path of travel of the infrared beam from the beam projecting unit towards the beam receiving unit. The beam projecting unit includes a mounting base provided with a sensor circuit and a projector cover detachably mounted on the mounting base for enclosing and protecting the sensor circuit. The beam projecting unit also includes an opening detecting switch for detecting a physical opening of the projector cover and a projected beam suppressing circuit operable in response to detection by the opening detecting switch to reduce the amount of the infrared beam emitted from the beam projecting unit to thereby reproduce reduction of the amount of infrared beam caused by the projector cover or reproduce the infrared beam of a quantity or level substantially equal to that having passed through the projector cover.

With this anti-thief security sensor assembly according to the present invention, when the projector cover is physically opened at the time of installation or servicing of the anti-thief security sensor assembly, the opening detecting switch detects such physical opening of the projector cover and provides the projected beam suppressing circuit with a detection signal indicative of the physical opening of the projector cover. The projected beam suppressing circuit, in response to the detection signal from the opening detecting switch, controls the beam projecting unit to cause the latter to emit an infrared beam of a signal level substantially equal to the amount of the infrared beam attenuated by the projector cover as it pass through the latter. In other words, even though the projector cover is physically removed, the beam projecting unit emits the infrared beam at the same level as that when the projector cover is mounted. Accordingly, in the beam receiving unit, by manipulating the sighting instrument so as to render the received beam signal to attain a predetermined signal level, the optical axis of the beam receiving unit can be accurately adjusted relative to that of the beam projecting unit, essentially regardless of whether the projector cover is mounted or removed.

The present invention in accordance with another aspect thereof provides an anti-thief security sensor assembly including a beam projecting unit for projecting an infrared beam and a beam receiving unit for receiving the infrared beam projected by the beam projecting unit and operable to detect a human body or the like in the event that the human body or the like traverses the optical path of travel of the infrared beam from the beam projecting unit towards the beam receiving unit. The beam receiving unit includes a mounting base provided with a sensor circuit and a receiver cover detachably mounted on the mounting base for enclosing and protecting the sensor circuit. The beam receiving unit also includes an opening detecting switch for detecting a physical opening of the receiver cover and a received beam level suppressing circuit operable in response to detection by the opening detecting switch to lower the level of the beam signal received by the beam receiving unit so as to reproduce reduction of the amount of the received infrared beam caused by the receiver cover.

With this anti-thief security sensor assembly according to the present invention, when the receiver cover is physically opened at the time of installation or servicing of the anti-thief security sensor assembly, the opening detecting switch detects such physical opening of the receiver cover and provides the received beam level suppressing circuit with a detection signal indicative of the physical opening of the receiver cover. The received beam level suppressing circuit operates, in response to the detection signal from the opening detecting switch, to reduce a signal level of the infrared beam received by the beam receiving unit, by a quantity corresponding to the amount of the infrared beam absorbed and attenuated by the receiver cover.

Accordingly, even though the receiver cover is removed, a level meter for displaying an output from a detecting circuit in the beam receiving unit provides a display of the received beam signal at the same level as that being received while the receiver cover is mounted. Accordingly, if the use is made of, for example, a communication means in the beam receiving unit for transmitting the received beam level to the beam projecting unit such as disclosed in the Japanese Laid-open Patent Publication No. 4-71099 so that if the accuracy of the optical axis adjustment at the beam projecting unit can be increased, the optical axis adjustment of the beam projecting unit can be advantageously performed regardless of whether the receiver cover is mounted or removed.

The present invention in accordance with a further aspect thereof provides an anti-thief security sensor assembly including a beam projecting unit for projecting an infrared beam and a beam receiving unit for receiving the infrared beam projected by the beam projecting unit and operable to detect a human body or the like in the event that the human body or the like traverses the optical path of travel of the infrared beam from the beam projecting unit towards the beam receiving unit. The beam receiving unit includes a mounting base provided with a sensor circuit and a receiver cover detachably mounted on the mounting base for enclosing and protecting the sensor circuit. The beam receiving unit also includes an opening detecting switch for detecting a physical opening of the receiver cover, and a transmission circuit operable in response to detection by the opening detecting switch to transmit an opening detection signal from the opening detection switch, which is indicative of the physical opening of the receiver cover, from the beam receiving unit to the beam projecting unit. On the other hand, the beam projecting unit is provided with a receiving circuit for receiving the opening detection signal transmitted from the transmission circuit, and a projected beam suppressing circuit operable in response to receipt of the opening detection signal from the opening detection switch via the transmission circuit to reduce the amount of the infrared beam emitted by the beam projecting unit to thereby reproduce the infrared beam of a quantity or level substantially equal to that having passed through the receiver cover.

With this anti-thief security sensor assembly according to the further aspect of the present invention, when the receiver cover is physically opened to perform the optical axis adjustment at the time of installation or servicing of the anti-thief security sensor assembly, the opening detecting switch detects such physical opening of the receiver cover and provides the transmission circuit in the beam receiving unit with an opening detection signal indicative of the physical opening of the receiver cover. The transmission circuit in the beam receiving unit then transmits the opening detection signal from the beam receiving unit to a signal receiving circuit in the beam projecting unit which, in response to receipt of the opening detection signal, activates the projected beam suppressing circuit to control the beam projecting unit so as to cause the latter to emit the infrared beam of a signal level reduced by a quantity corresponding to the amount of the infrared beam absorbed and attenuated by the receiver cover.

Accordingly, in the beam receiving unit, even while the projector cover is remain mounted, by manipulating the sighting instrument in the beam receiving unit so as to render the received beam signal to attain a predetermined signal level, the optical axis of the beam receiving unit can be accurately adjusted relative to that of the beam projecting unit. Also, since the projector cover need not be removed, the workability can be advantageously increased.

In further preferred embodiments of the present invention, the present invention provide the beam projecting and receiving units both employed in the anti-thief security sensor assembly of the structure discussed above.

It is to be noted that the term "physical opening" used in connection with the projector and receiver cover in the description made hereinabove and hereinafter is intended not only to means that the cover is hingedly opened relative to the associated base to which it is hinged, but also to means that the cover is removed away from the associated base and is thus used in the sense that when the cover is opened, internal component parts covered and projected by such cover are rendered open to the outside regardless of whether the cover remains hingedly affixed to the associated base or whether it be separated from the associated base.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, an anti-thief security sensor assembly according to each of the preferred embodiments of the present invention will be described in detail.

Figure 1:
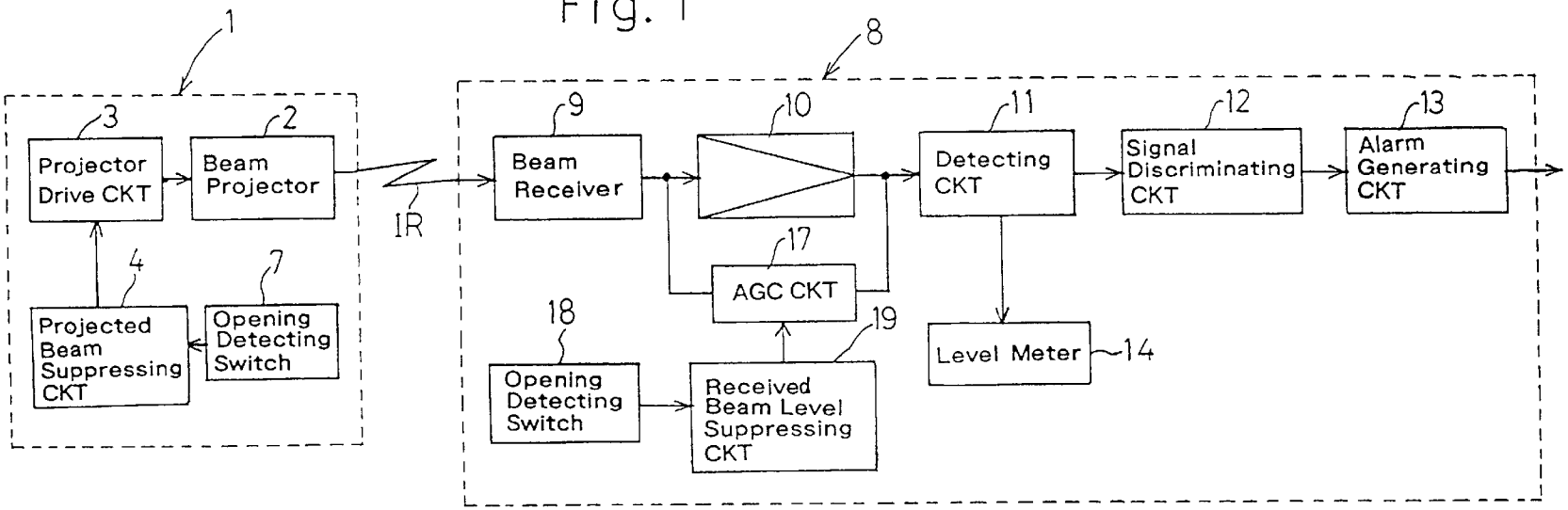
FIG. 1 is a circuit block diagram showing an anti-thief security sensor assembly according to a preferred embodiment of the present invention.

Referring first to FIG. 1 showing a circuit block diagram of the anti-thief security sensor assembly according to a first preferred embodiment of the present invention, the anti-thief security sensor assembly shown therein includes a beam projecting unit 1 and a beam receiving unit 8 adapted to be fixedly mounted on corresponding wall surfaces or support poles, which are positioned at opposite ends of a rectilinear guard area spaced an appropriate distance from each other, with their optical axes aligned with each other. Each of the beam projecting and receiving units 1 and 8 is unitarized into a respective module.

The beam projecting unit 1 includes a beam projector 2, a projector drive circuit 3, a projected beam suppressing circuit 4 and a projector-side opening detecting switch 7. A group of the beam projector 2, the projector drive circuit 3 and the projected beam suppressing circuit 4 are employed in a pair as will be described in detail later, but in FIG. 1, only one of the pair is shown. The beam projector 2 includes a light emitting element such as, for example, an infrared light emitting diode, and a projector optics such as, for example, a projector lens or a reflecting lens for forming an infrared beam IR such as, for example, a near infrared beam and is operable to emit the infrared beam IR. The projector drive circuit 3 is operable to electrically drive the beam projector 2 to cause the light emitting element to be driven and emit light at a predetermined frequency so that the infrared beam IR in the form of a pulse modulated wave can be emitted therefrom.

The projector-side opening detecting switch 7 is a contact type or a proximity type switch for detecting opening or closure of a projector cover, as will be described later, relative to a projector base 20A. This projector-side opening detecting switch 7 concurrently serves as an existing damper switch utilized to detect a nuisance opening of the projector cover 21A and then to output an alarm signal. The projected beam suppressing circuit 4 controls the projector drive circuit 3, when the opening detecting switch 7 is turned off as a result of detection of the physical opening of a projector cover, to lower a supply of an electric power to the light emitting element of the beam projector 2. In other words, the projected beam suppressing circuit 4 controls the projector drive circuit 3 so that the electric driving power of a value sufficient to lower the amount of the infrared beam IR emitted from the light emitting element by a quantity, for example, 30% corresponding to the amount of the infrared beam IR attenuated by the projector cover 21A as it passes therethrough can be supplied from the projector drive circuit 3 to the light emitting element of the beam projector 2.

On the other hand, the beam receiving unit 8 includes a beam receiver 9 made up of a receiver optics such as, for example, a beam receiving lens or a beam collecting mirror, and a light receiving element such as, for example, a phototransistor. This beam receiver 9 is operable to detect the infrared beam IR projected from the beam projecting unit 1 and then to output an electric signal of a level proportional to the amount of the infrared beam IR received thereby. This electric signal is, after having been amplified by an amplifier circuit 10, fed to a detecting circuit 11 where the electric signal is, after a disturbance light component contained in the electric signal has been removed by the detecting circuit 11, converted into a signal of a level proportional to the level of the received beam signal solely in the form of the pulse modulated wave, which signal level is subsequently determined by a signal discriminating circuit 12 as to whether or not the signal level is lower than a predetermined detection level. In the event that the level of the received beam signal attains a value lower than the predetermined intrusion detection level as a result of the infrared beam IR from the beam projecting unit 1 having been intercepted by traverse of an intruder, the signal discriminating circuit 12 outputs a detection signal with which an alarm generating circuit 13 is driven to output an alarm signal warning that the intruder has entered the guard area. This alarm signal may be utilized in numerous way and may be communicated to a security center (not shown) and/or utilized to trigger an alarm and/or a lighting instrument on.

A level meter 14 such as, for example, a voltmeter is electrically connected with the detecting circuit 11 so that the signal level proportional to the amount of the infrared beam received by the beam receiver 9 can be displayed by the level meter 14. The amplifier circuit 10 referred to above is gain controlled by an AGC (automatic gain control) circuit 17 in dependence on the level of the signal received from the beam receiver 9 so that an output from the amplifier circuit 10 can be controlled to a value lower than a predetermined signal level at all times. If desired, a level display device that can be lit when the level of the received beam signal exceeds the predetermined level may be electrically connected with the detecting circuit 11 in combination with or in place with the level meter 14.

It is to be noted that a group of the beam receiver 9, the amplifier circuit 10, the detecting circuit 11, the signal discriminating circuit 12 and the level meter 14 are also employed in a pair as will become clear from the subsequent description, but only one of the pair is shown in FIG. 1.

The beam receiving unit 8 also includes a receiver-side opening detecting switch 18 and a received beam level suppressing circuit 19. The receiver-side opening detecting switch 18 may be a contact type or proximity type switch for detecting the opening and closure of a receiver cover 21, as will be described later, and concurrently serves as an existing damper switch utilized to detect a nuisance opening of the receiver cover 21 and then to output an alarm signal. The received beam level suppressing circuit 19 controls the AGC circuit 17 to lower the gain thereof when the receiver-side opening detecting switch 18 is turned off as a result of detection of the physical opening of the receiver cover 21. In other words, the received beam level suppressing circuit 19 is operable to lower the gain of the amplifier circuit 10 through the AGC circuit 17 to amplify the signal level of the received beam signal from the beam receiver 9 by lowering such signal level by a quantity, for example, 30% corresponding to the amount of the received infrared beam attenuated by the receiver cover 21 as it passes through the receiver cover 21.

Figure 2:
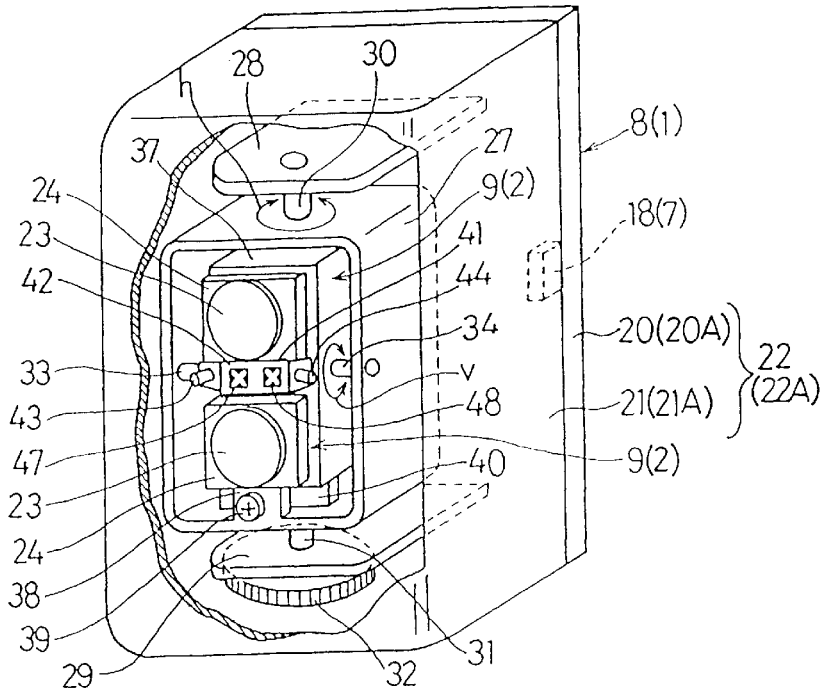
FIG. 2 is a schematic perspective view showing the anti-thief security sensor assembly, with a portion of a beam receiving unit shown as cut out.

FIG. 2 illustrates the beam receiving unit 8 with a portion thereof cut out. It is to be noted that since the beam projecting unit 1 is of a structure substantially similar to that of the beam receiving unit 8 and, accordingly, reference numerals allocated to similar component parts of the beam projecting unit 1 are also shown in FIG. 2 although the following description is directed to that of the beam receiving unit 8.

The beam receiving unit 8 includes a casing 22 comprised of a mounting base 20 being fixed to a wall surface or a support pole and the receiver cover 21 detachably supported by the mounting base 20. The receiver-side opening detecting switch 18 shown in and discussed with reference to FIG. 1 for detecting a physical opening of the receiver cover 21 is mounted fixedly on the mounting base 20. The receiver cover 21 is made of a material such as, for example, a synthetic resin of a kind capable of relatively favorably passing an near-infrared rays, but attenuating it by about 30% of the near-infrared beam IR incident on the receiver cover and is treated to represent a black color or a similar dark color sufficient to inhibit passage of visible rays of light therethrough.

The mounting base 20 has upper and lower spaced support members 28 and 29 fixed thereto so as to protrude perpendicular to the mounting base 20. A generally box-like receiver chassis 27 is swingably supported in between the upper and lower support members 28 and 29 by means of coaxially aligned vertical stud shafts 30 and 31. A generally rectangular lens holder 37 having coaxially aligned horizontal stud shafts 33 and 34 protruding laterally outwardly therefrom is accommodated within the receiver chassis 27 and is tiltably supported by opposite side walls of the receiver chassis 27 with the horizontal stud shafts 33 and 34 journalled thereto. Upper and lower beam receiving lenses 23 positioned one above the other are retained by a lens casing 24 which is in turn carried by the lens holder 37. A light emitting element (not shown) forming the beam receiver 9 in cooperation with the beam receiving lenses 23 is mounted on a printed circuit board (not shown) and is in turn accommodated within the lens holder 37 and positioned at a location rearwardly of the beam receiving lenses 23.

Accordingly, it will readily be seen that the beam receiver 9 has an adjustable angle of swing in a horizontal direction, shown by the arrow h, as the receiver chassis 27, as will be described later, can be adjustably swung about a common axis defined by the vertical stud shafts 30 and 31, and also has an adjustable angle of tilt in a vertical direction, shown by the arrow v, as the lens holder 37, as will be described later, can be adjustably tilted about a common axis defined by the horizontal stud shafts 33 and 34, wherefore the optical axis can be aligned relative to the beam projector 2 of FIG. 1. As will be described in detail later, the optical axis alignment is carried out by the aid of a sighting instrument. Also, the sensor circuit of the circuit configuration of FIG. 1 including the circuit elements 9 to 14, 17 and 19 and excluding the opening detecting switch 18 is mounted on the printed circuit board referred to above, which is in turn mounted inside the lens holder 37. Thus, the sensor circuit mounted inside the lens holder 37 is covered and protected by the receiver cover 21 through the lens holder 37. In the case of the beam projecting unit 1, the sensor circuit of the circuit configuration of FIG. 1 including the circuit elements 2 to 4 and excluding the opening detecting switch 7 is similarly covered and protected by the projector cover 21A.

One of the stud shafts, that is, the lower stud shaft 31 rotatably extends through the lower support member 29 and terminates with an adjustment knob 32 secured thereto for rotation together with the lower stud shaft 31 and used for adjustment of the horizontal angle of the lens holder 37. The receiver chassis 27 has a mounting flange 38 extending upwardly from a generally intermediate portion of a lower front edge of a lower wall of the receiver chassis 27, which flange 38 has an adjustment screw 39 rotatably coupled thereto. This adjustment screw 39 extends loosely through the mounting flange 38 and is then threaded into a projection 40 protruding downwardly from a lower end of the lens holder 37 so as to occupy a position behind the mounting flange 38. Accordingly, it will readily be seen that turn of the adjustment knob 32 results in adjustment of the angle of swing of the beam receiver 9 through the beam receiver chassis 27 and turn of the adjustment screw 39 results in adjustment of the angle of tilt of the beam receiver 9 through the lens holder 37.

It is to be noted that in the event that the two beam receivers 9 that are paired in the beam receiving unit 8 output respective detection signals, an alarm signal can be outputted from the alarm generating circuit 13.

The sighting instrument for aiding the optical axis adjustment is identified by 41 and is provided at a position substantially intermediate of the lens holder 37 with respect to the lengthwise direction thereof and generally between the beam receiving lenses 23. This sighting instrument 41 includes a pair of left and right viewing holes 43 and 44 provided in a sighting instrument casing 42, a pair of left or right sighting holes 47 and 48 employed in association with each of the viewing holes 43 and 44, and a pair of left or right reflecting mirrors (not shown) provided in the sighting instrument casing 42 and employed in association with each of the viewing holes 43 and 44. This sighting instrument 41 can be operated in such a manner that while a servicing worker looks into one of the viewing holes 43 or 44, one or both of the adjustment knob 32 and the adjustment screw 39 have to be turned to adjust the angle of swing and/or the angle of tile of the beam receiver 9 until an image of the beam projector 2 cast on the associated reflecting mirror aligns with an associated one of the sighting holes 47 or 48. In this way, the optical axes of the beam projecting and receiving units 1 and 8 can be aligned with each other. It is to be noted that the beam projector 2 shown in FIG. 1 has a physical structure similar to that of the beam receiver 9 discussed above.

With the anti-thief security sensor assembly according to the foregoing embodiment of the present invention, while the projector cover 21A of the beam projecting unit 1 is physically opened and the servicing worker then views through one of the viewing holes 43 and 44 of the sighting instrument 41, the adjustment knob 32 and/or the adjustment screw 39 have to be turned to adjust the optical axis of the beam projecting unit 1. Thereafter, the receiver cover 21 of the beam receiving unit 8 has to be physically opened and, while the servicing worker similarly views through the sighting instrument 41, the adjustment knob 32 and/or the adjustment screw 39 in the beam receiving unit 8 have to be turned to effect coarse adjustment of the optical axis of the beam receiving unit 8. Next, while the servicing worker checks the reading of the level meter 14, the adjustment knob 22 and/or the adjustment screw 39 have to be turned to effect fine adjustment of the optical axis until the level of the reading attains a maximum value. This optical axis adjustment of each of the beam projecting and receiving units 1 and 8 has to be repeated a number of time until the reading of the level meter 14 attains a value equal to or higher than the predetermined level, that is, until the optical axis of the beam receiver 9 aligns exactly with that of the beam projector 2.

Assuming that the projector cover 21A of the beam projecting unit 1 is physically opened, the associated opening detecting switch 7 detects the physical opening of the projector cover 21A and supplies the detection signal to the projected beam suppressing circuit 4. In response to the detection signal so supplied, the projected beam suppressing circuit 4 controls the projector drive circuit 3 to reduce the amount of the electric power to be supplied to the light emitting element of the beam projector 2. In this way, the beam projector 2 emits the infrared beam IR having its signal level lowered by the quantity corresponding to the amount of the infrared beam attenuated by the projector cover 21A as it passes therethrough. In other words, even though the projector cover 21A is physically opened, the beam projecting unit 1 emits the infrared beam IR at the same signal level as that when the projector cover 21A is mounted. For this reason, at the site of installation of the beam receiving unit 8, the optical axis adjustment can be performed regardless of whether the projector cover 21A in the beam projecting unit 1 is detached or mounted, resulting in increase of the workability.

During the optical axis adjustment being performed in the beam receiving unit 8 as described above, the opening detecting switch 18 detects the physical opening of the cover 21 with the detection signal consequently supplied to the received beam level suppressing circuit 19 and, hence, the received beam level suppressing circuit 19 operates in response to the detection signal to control the gain of the amplifying circuit 10 through the AGC circuit 17 to thereby reduce the signal level of the received beam signal of the beam receiver 9 by the quantity corresponding to the amount of the infrared beam attenuated by the cover 21. For this reason, even though the cover 21 is physically opened, the level meter 14 capable of displaying the output from the detecting circuit 11 of the beam receiving unit 8 displays the received beam signal at the same signal level as that afforded when the cover 21 is mounted. Accordingly, where, for example, a transmission means is provided in the beam receiving unit 8 for transmitting the received beam level to the beam projecting unit 1 so that the accuracy of the optical axis adjustment at the site of installation of the beam projecting unit 1 can be increased, it is possible to achieve the optical axis adjustment in the beam projecting unit 1 regardless of whether the receiver cover 21 of the beam receiving unit 8 is detached or mounted.

Figure 3:
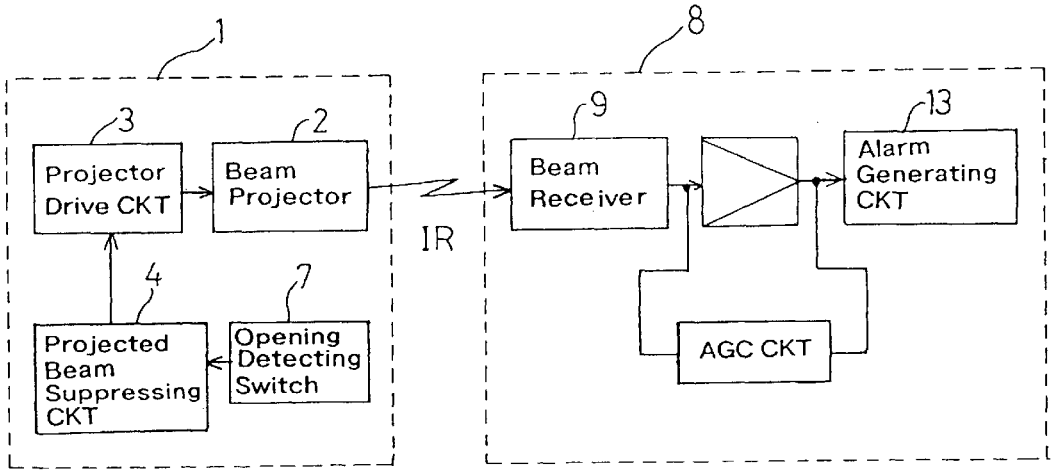
FIG. 3 is a circuit block diagram showing the anti-thief security sensor assembly according to another preferred embodiment of the present invention.

FIG. 3 illustrates a circuit block diagram of the anti-thief security sensor assembly according to another preferred embodiment of the present invention. In FIG. 3, component parts shown therein and similar to those shown in FIG. 1 are designated by like reference numerals and, therefore, the description of those component parts is not reiterated for the sake of brevity. In this embodiment shown in FIG. 3, the anti-thief security sensor assembly is so designed that at the time the optical axis adjustment of the beam receiving unit 8 is to be performed with the receiver cover 21 removed, the projected beam suppressing circuit 4 when inputted with the detection signal from the opening detecting switch 7 controls the projector drive circuit 3 to lower the amount of the electric power to be supplied therefrom to the light emitting element of the projector 2 so that the projector 2 can emit the infrared beam IR of a signal level that is reduced 60% relative to the normal signal level. Accordingly, the beam receiving unit 8 may be of any known circuit configuration where no received beam level suppressing circuit 19 is employed.

With the anti-thief security sensor assembly shown in FIG. 3, even though the cover 21A has been physically opened, the infrared beam IR of the same signal level as that afforded when the cover 21A is mounted can be emitted. For this reason, at the site of installation of the beam receiving unit 8, the optical axis adjustment can be performed regardless of whether the projector cover of the beam projecting unit 1 is mounted or detached, resulting in increase of the workability.

Figure 4:
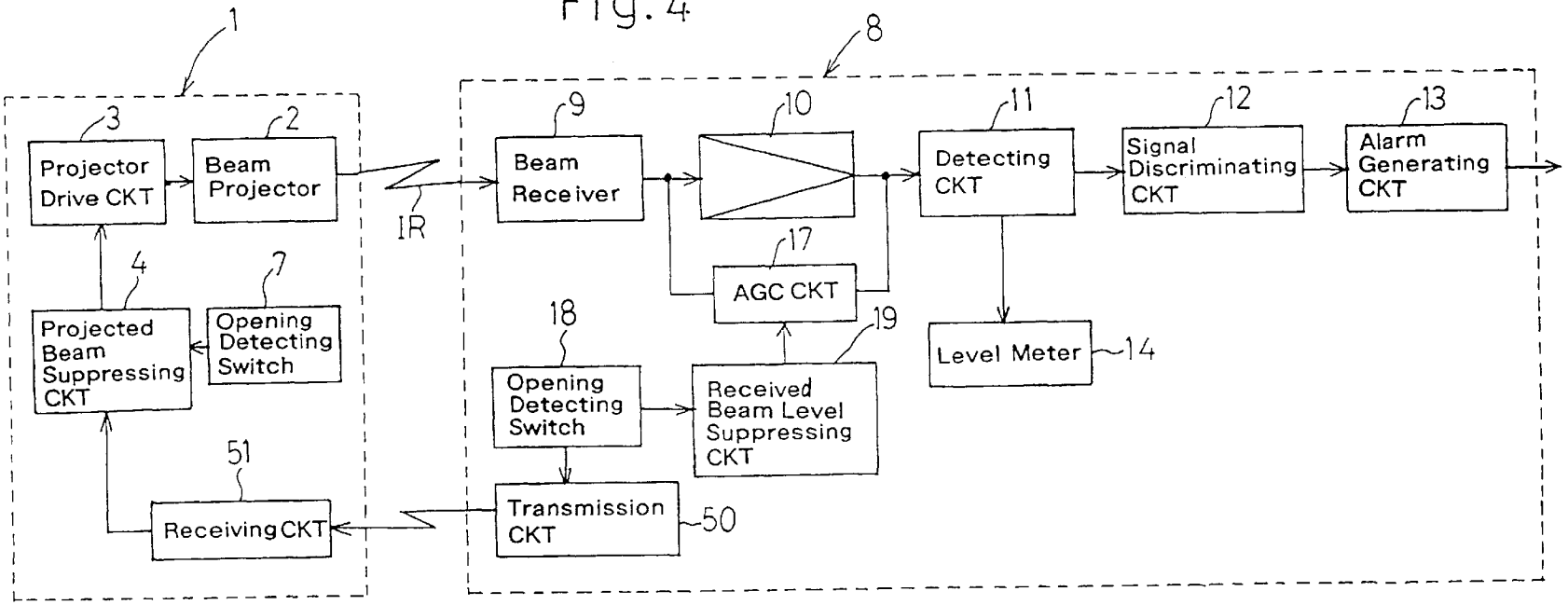
FIG. 4 is a circuit block diagram showing primary elements of the anti-thief security sensor assembly according to a further preferred embodiment of the present invention.

FIG. 4 illustrates a circuit block diagram of the anti-thief security sensor assembly according to a further preferred embodiment of the present invention. In FIG. 4, component parts shown therein and similar to those shown in FIG. 1 are designated by like reference numerals and, therefore, the description of those component parts is not reiterated for the sake of brevity. In this embodiment shown in FIG. 4, the anti-thief security sensor assembly is provided with a transmission circuit 50 disposed in the beam receiving unit 8 and a receiving circuit 51 disposed in the beam projecting unit 1. This transmission circuit 50 is utilized to transmit the opening detection signal, inputted from the opening detecting switch 18, from the beam receiving unit 8 to the beam projecting unit 1. The receiving circuit 51 is utilized to receive the opening detection signal transmitted from the beam receiving unit 8 through the transmission circuit 50 and then to supply the received opening detection signal to the projected beam suppressing circuit 4. It is to be noted that the received beam level suppressing circuit 19 shown in FIG. 1 is not employed in the beam receiving unit 8.

With the anti-thief security sensor assembly shown in FIG. 4, when the receiver cover 21 of the beam receiving unit 8 is physically opened, the detection signal indicative of the physical opening of the receiver cover 21 is transmitted from the receiver-side opening detecting switch 18 to the receiving circuit 51 in the beam projecting unit 1 through the transmission circuit 50. In the beam projecting unit 1, the detection signal so received by the receiving circuit 51 is supplied to the projected beam suppressing circuit 4 to reduce the amount of the electric power supplied to the projector drive circuit 3 so that the infrared beam of a level lowered 30% relative to the normal level, which corresponds to the infrared beam reduced by the quantity generally equal to the amount of the infrared beam attenuated by the receiver cover 21 of the beam receiving unit 8, can be emitted from the projector 2. On the other hand, where the opening detection signals indicative of the physical opening of the receiver cover 21 and 21A are inputted to the projected beam suppressing circuit 4 from both the projector-side opening detection switch 7 and the receiving circuit 51, the projected beam suppressing circuit 4 controls the projector drive circuit 3 to cause the beam projector 2 to emit the infrared beam IR of a level reduced 60% relative to the normal level. For this reason, at the site of installation of the beam receiving unit 8, regardless of whether the projector cover 21A is detached or mounted, by manipulating the sighting instrument so as to render the received signal to attain the predetermined signal level, the optical axis can be accurately adjusted. Also, in the beam receiving unit 8, the optical axis can be adjusted with no need to remove the projector cover 21A of the beam projecting unit 1 and, accordingly the workability can be increased.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. An anti-thief security sensor assembly which comprises:

a beam projecting unit for projecting an infrared beam; and a beam receiving unit for receiving the infrared beam projected by the beam projecting unit and operable to detect a human body in the event that the human body traverses the optical path of travel of the infrared beam from the beam projecting unit towards the beam receiving unit;

said beam projecting unit comprising a mounting base provided with a sensor circuit and a projector cover detachably mounted on the mounting base for enclosing and protecting the sensor circuit, an opening detecting switch for detecting a physical opening of the projector cover, and a projected beam suppressing circuit operable in response to detection by the opening detecting switch to reduce a quantity of the infrared beam emitted from the beam projecting unit to thereby reproduce reduction of the amount of the infrared beam caused by the projector cover.

2. The anti-thief security sensor assembly as claimed in claim 1, wherein the beam projecting unit also includes a beam projector for emitting the infrared beam and a projector drive circuit for electrically driving the beam projector, and wherein said projected beam suppressing circuit controls the projector drive circuit to suppress an amount of driving power of the beam projector.

3. An anti-thief security sensor assembly which comprises:

a beam projecting unit for projecting an infrared beam; and a beam receiving unit for receiving the infrared beam projected by the beam projecting unit and operable to detect a human body in the event that the human body traverses the optical path of travel of the infrared beam from the beam projecting unit towards the beam receiving unit;

said beam receiving unit comprising a sensor circuit having a receiver member and a receiver cover detachably mounted on the mounting base for enclosing and protecting the sensor circuit, an opening detecting switch for detecting a physical opening of the receiver cover and a received beam level suppressing circuit operable in response to detection by the opening detecting switch to lower the level of the beam signal received by the beam receiver member to thereby reproduce reduction of the amount of the received infrared beam caused by the receiver cover.

4. The anti-thief security sensor assembly as claimed in claim 3, wherein the beam receiving unit further comprises an amplifier circuit for amplifying the electric signal from the beam receiver member, and wherein the received beam level suppressing circuit controls a gain of the amplifier circuit to thereby reduce the received beam level.

5. An anti-thief security sensor assembly which comprises:

a beam projecting unit for projecting an infrared beam; and a beam receiving unit for receiving the infrared beam projected by the beam projecting unit and operable to detect a human body in the event that the human body traverses the optical path of travel of the infrared beam from the beam projecting unit towards the beam receiving unit;

said beam receiving unit comprising a mounting base provided with a sensor circuit and a receiver cover detachably mounted on the mounting base for enclosing and protecting the sensor circuit, an opening detecting switch for detecting a physical opening of the receiver cover, and a transmission circuit operable in response to detection by the opening detecting switch to transmit an opening detection signal from the opening detection switch via the transmission circuit, which is indicative of the physical opening of the receiver cover, from the beam receiving unit to the beam projecting unit; and said beam projecting unit comprising a receiving circuit for receiving the opening detection signal transmitted, and a projected beam suppressing circuit operable in response to receipt of the opening detection signal by the receiving circuit to reduce an amount of the infrared beam emitted from the beam projecting unit to thereby reproduce reduction of the amount of the received infrared beam caused by the receiver cover.

6. The anti-thief security sensor assembly as claimed in claim 5, wherein the beam projecting unit also includes a beam projector for emitting the infrared beam and a projector drive circuit for electrically driving the beam projector, and wherein said projected beam suppressing circuit controls the projector drive circuit to suppress an amount of driving power of the beam projector.

7. For use with an anti-thief security sensor assembly which comprises a beam projecting unit for projecting an infrared beam, and a beam receiving unit for receiving the infrared beam projected by the beam projecting unit and operable to detect a human body in the event that the human body traverses the optical path of travel of the infrared beam from the beam projecting unit towards the beam receiving unit, the beam projecting unit which comprises:

a mounting base provided with a sensor circuit and a projector cover detachably mounted on the mounting base for enclosing and protecting the sensor circuit; and an opening detecting switch for detecting a physical opening of the projector cover, and a projected beam suppressing circuit operable in response to detection by the opening detecting switch to reduce a quantity of the infrared beam emitted from the beam projecting unit to thereby reproduce reduction of the amount of the infrared beam caused by the projector cover.

8. The anti-thief security sensor assembly as claimed in claim 7, wherein the beam projecting unit also includes a beam projector for emitting the infrared beam and a projector drive circuit for electrically driving the beam projector, and wherein said projected beam suppressing circuit controls the projector drive circuit to suppress an amount of driving power of the beam projector.

9. For use with an anti-thief security sensor assembly which comprises a beam projecting unit for projecting an infrared beam, and a beam receiving unit for receiving the infrared beam projected by the beam projecting unit and operable to detect a human body in the event that the human body traverses the optical path of travel of the infrared beam from the beam projecting unit towards the beam receiving unit, the beam receiving unit which comprises:

a sensor circuit having a beam receiver member and a receiver cover detachably mounted on a mounting base for enclosing and protecting the sensor circuit;

an opening detecting switch for detecting a physical opening of the receiver cover; and a received beam level suppressing circuit operable in response to detection by the opening detecting switch to lower the level of the beam signal received by the beam receiver member to thereby reproduce reduction of the amount of the received infrared beam caused by the receiver cover.

10. The anti-thief security sensor assembly as claimed in claim 9, wherein the beam receiving unit further comprises an amplifier circuit for amplifying the electric signal from the beam projector, and wherein the received beam level suppressing circuit controls a gain of the amplifier circuit to thereby reduce the received beam level.

11. A security sensor assembly for defining a line of sight monitor beam between two predetermined spaced apart positions, comprising:

an infrared beam projecting unit for actively projecting an infrared monitor beam from a first predetermined position; and an infrared beam receiving unit for receiving projected infrared monitor beam at a second predetermined position;

the infrared beam receiving unit comprising a mounting base with a removable receiver cover that reduces an intensity of the infrared monitor beam as it passes through the receiver cover, a sensor unit movably mounted relative to the mounting base and receiver cover to enable alignment with an optical axis of the infrared beam from the infrared beam projecting unit, a sighting unit operatively mounted to the infrared beam receiving unit to enable a user to align the sensor unit with the optical axis of the infrared monitor beam, an opening detecting unit for detecting a removal of the receiver cover and a beam level suppressing circuit operable in response to detection by the opening detection unit to lower the level of the infrared monitor beam signal received by the sensor unit to compensate for the effect on the intensity of the infrared monitor beam with the removal of the receiver cover.

12. The security sensor assembly of claim 11 further including a transmission circuit operatively connected to the opening detecting unit to provide a signal to the infrared beam projecting unit to reduce the intensity of the projected infrared monitor beam.

13. The security sensor assembly of claim 11 wherein the beam level suppressing circuit is in the infrared beam projecting unit and a beam projector drive circuit is adjusted by the beam level suppressing circuit.

14. The security sensor assembly of claim 13 wherein the infrared beam projecting unit includes a removable projection cover and a second opening detecting unit for detecting removal of the projection cover, the second opening detecting unit is operably connected to the beam level suppressing circuit.

15. The security sensor assembly of claim 11 wherein the beam level suppressing circuit is in the infrared beam receiving unit.

* * * * *